US008240822B2

(12) United States Patent
Yokouchi et al.

(10) Patent No.: US 8,240,822 B2
(45) Date of Patent: Aug. 14, 2012

(54) LIQUID SUPPLY APPARATUS, LIQUID EJECTING APPARATUS

(75) Inventors: Hideya Yokouchi, Okaya (JP); Hiroyuki Ito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 373 days.

(21) Appl. No.: 12/722,348

(22) Filed: Mar. 11, 2010

(65) Prior Publication Data

US 2010/0238240 A1 Sep. 23, 2010

(30) Foreign Application Priority Data

Mar. 23, 2009 (JP) ..... 2009-070477

(51) Int. Cl.
*B41J 2/175* (2006.01)

(52) U.S. Cl. ..... 347/85

(58) Field of Classification Search ..... 347/84–86, 347/92

See application file for complete search history.

(56) References Cited

U.S. PATENT DOCUMENTS

| | | | | |
|---|---|---|---|---|
| 7,524,044 | B2 | 4/2009 | Kumagai | |
| 2004/0090501 | A1 * | 5/2004 | Yoshida et al. | 347/85 |
| 2010/0245496 | A1 * | 9/2010 | Yokota | 347/85 |

FOREIGN PATENT DOCUMENTS

JP 2006-272661 10/2006

* cited by examiner

*Primary Examiner* — Kristal Feggins
(74) *Attorney, Agent, or Firm* — Workman Nydegger

(57) ABSTRACT

A liquid supply apparatus supplies liquid from a liquid container through a liquid supply path to a recording head. A liquid supply pump drives when a flexible member is displaced such that a volume of a pump chamber is increased or decreased while a part of the liquid supply path is set as the pump chamber. A negative pressure chamber is divided from the pump chamber by the flexible member. A first directional valve in the liquid supply path passes the liquid in one direction toward the supply pump from the liquid container. A second directional valve passes the liquid in one direction toward the liquid ejecting apparatus from the supply pump. A pressure adjustor between the first directional valve and the second directional valve increases a volume of the liquid container when a negative pressure larger than a predetermined pressure is applied to the negative pressure chamber.

16 Claims, 7 Drawing Sheets

<AT SUCTION DRIVING>

<AT DISCHARGE DRIVING>

<AT DISCHARGE DRIVING 2>

<AT SUCTION DRIVING>

<AT DISCHARGE DRIVING>

<AT SUCTION DRIVING>

<AT DISCHARGE DRIVING>

<AT DISCHARGE DRIVING>

LIQUID SUPPLY APPARATUS, LIQUID EJECTING APPARATUS

This application claims the benefit of Japanese Patent Application No. 2009-070477, filed Mar. 23, 2009, which is expressly incorporated herein by reference in its entirety.

BACKGROUND

1. Technical Field

The present invention relates to a liquid supply apparatus which supplies liquid, particularly to a liquid supply apparatus including a diaphragm pump.

2. Related Art

There is an ink jet printer in which an ink cartridge is arranged on a main body side of the printer and ink is supplied to a recording head of the ink jet printer from the ink cartridge through an ink supply path. In such a printer, a supply pump such as a diaphragm pump is arranged on the ink supply path so as to pressure-supply ink to the recording head side from the ink cartridge side by applying a pressure to the ink (for example, JP-A-2006-272661).

In general, when the diaphragm pump is driven by supplying a negative pressure to the diaphragm pump, a spring biasing the diaphragm is contracted with the negative pressure, and the diaphragm abuts against a stopper so that ink is sucked into an ink chamber containing ink. After the negative pressure is released, the diaphragm is pressurized only by the biasing force of the spring so that the ink in the ink chamber is pressurized and supplied.

However, there are variations in environment of usage of the printer and errors in manufacturing the diaphragm pump. Therefore, the negative pressure supplied to the diaphragm is not constant. Accordingly, when the negative pressure supplied to the diaphragm is larger than a predetermined pressure, the diaphragm is also expanded with the negative pressure after the diaphragm abuts against the spring so that the diaphragm stops at a position where the diaphragm balances with the supplied negative pressure. As a result, when ink is supplied by releasing the negative pressure, a supply pressure of the ink is increased. This causes a risk that the ink supply path at a joint portion or the like may be damaged. Further, a variation in the supply pressure of ink is generated.

SUMMARY

An advantage of some aspects of the invention is to supply ink at a stable supply pressure from a supply pump.

APPLICATION EXAMPLE 1

A liquid supply apparatus which supplies liquid from a liquid container containing the liquid to a recording head from which the liquid is ejected includes a liquid supply path which communicates the liquid container with the recording head, a liquid supply pump which pump-drives when a first flexible member constituting at least a part of an inner surface of a pump chamber is displaced such that a volume of the pump chamber is increased or decreased while a part of the liquid supply path is set as the pump chamber, a negative pressure chamber which is divided from the pump chamber by the first flexible member and of which volume can be changed, a pressure reduction unit which applies a negative pressure to the negative pressure chamber, a first directional valve which is provided at the liquid supply path between the liquid container and the pump chamber and passes the liquid in one direction toward the supply pump from the liquid container, a second directional valve which is provided at the liquid supply path between the supply pump and the liquid ejecting apparatus and passes the liquid in one direction toward the liquid ejecting apparatus from the supply pump; and a pressure adjustor which is provided at the liquid supply path between the first directional valve and the second directional valve and which increases a volume corresponding to at least a part of an increase volume compared to the predetermined volume of the liquid container when a negative pressure larger than a predetermined liquid supply pressure is applied to the negative pressure chamber.

According to the liquid supply apparatus of the application example 1, the pressure adjustor is provided which adjusts a supply pressure of liquid to be supplied to the liquid ejecting apparatus by increasing a volume corresponding to at least a part of an increase volume between the first directional valve and the second directional valve after the negative pressure supplied to the negative pressure chamber is released. Accordingly, the flexible member is sucked with the negative pressure and deformed, and when the volume of the liquid container becomes a volume larger than a predetermined volume, the deformation of the flexible member starts to be turned back to an original state by releasing the negative pressure. At this time, first, a volume of the pressure adjustor is increased (expansion-changed) for at least a part of a volume which corresponds to the volume increase when the flexible member is deformed, that is, for at least a part of an increase volume compared to the predetermined volume of the liquid container. Accordingly, the liquid for the increase volume is suppressed from being supplied to the liquid ejecting apparatus through the second directional valve. Thereafter, the liquid supply pressure is defined only by the pressing force generated when the flexible member is turned back to the original state, and the liquid is supplied to the liquid supply apparatus. Therefore, since the pressure of the liquid supplied to the liquid supply apparatus is defined only by the pressing force of the flexible member, the liquid can be supplied to the liquid ejecting apparatus at a stable supply pressure. Further, the liquid supply apparatus can be prevented from being damaged.

APPLICATION EXAMPLE 2

In the liquid supply apparatus according to the application example 1, the pressure adjustor includes a pressure adjusting chamber which is provided between the supply pump and the second directional valve and has a volume which is at least equal to or larger than the increase volume, a volume change member which is provided so as to divide the pressure adjusting chamber into a first space and a second space and changes the volume of the first space, and a connector which connects the liquid supply path and the first space, and the volume change member increases the volume of the first space for at least a part of the increase volume after the negative pressure is released. According to the liquid supply apparatus of the application example 2, the pressure adjuster includes the pressure adjusting chamber connected to the liquid supply path and the volume change member which changes the volume of the first space of the pressure adjusting chamber for the increase volume after the negative pressure is released. Accordingly, the liquid supply pressure can be adjusted only by adding a configuration of the pressure adjustor without largely changing the configuration of the existing liquid supply path.

APPLICATION EXAMPLE 3

In the liquid supply apparatus according to the application example 2, the volume change member is a second flexible member which bends in the direction toward the second space from the first space and increases the volume of the first space. According to the liquid supply apparatus of the application example 3, since the flexible member is used as the volume change member, the volume of the first space can be changed with a simple configuration.

APPLICATION EXAMPLE 4

In the liquid supply apparatus according to the application example 3, the pressure adjustor further includes a biasing unit which biases the second flexible member in the direction opposite to the bending direction. According to the liquid supply apparatus of the application example 4, the flexible member is biased by the biasing unit in the direction opposite to the bending direction. Accordingly, abrasion of the flexible member can be suppressed.

APPLICATION EXAMPLE 5

In the liquid supply apparatus according to the application example 3 or 4, the second flexible member is formed with the same material as the first flexible member. According to the liquid supply apparatus of the application example 5, the flexible member is formed with the same material as the valve body. Accordingly, the flexible member as the volume change member of the pressure adjustor can be integrally formed with the valve body. With this configuration, the pressure adjustor can be easily formed.

APPLICATION EXAMPLE 6

In the liquid supply apparatus according to the application example 1, the pressure adjustor is a third flexible member which is provided so as to constitute a part of the liquid supply path, bends after the negative pressure is released, and increases a volume for at least a part of the increase volume. According to the liquid supply apparatus of the application example 6, the pressure adjustor is configured such that the flexible member forms a part of the liquid supply path. Accordingly, the volume of the liquid supply path can be expansion-changed for the increase volume of the liquid container after the negative pressure is released. As a result, liquid can be supplied to the liquid ejecting apparatus at a stable supply pressure while suppressing the number of components constituting the liquid supply path.

APPLICATION EXAMPLE 7

In the liquid supply apparatus according to the application example 1, the first directional valve includes a liquid container which contains liquid, and a valve body which divides the liquid container into a first space and a second space, and the pressure adjustor is a bending portion which is formed on the valve body of the first directional valve, bends after the negative pressure is released, and increases the volume for the increase volume. According to the liquid supply apparatus of the application example 7, the bending portion is provided on the first directional valve as a pressure adjustor. Accordingly, liquid can be supplied to the liquid ejecting apparatus at a stable supply pressure without increasing the number of components.

APPLICATION EXAMPLE 8

In the liquid supply apparatus according to any one of the application examples 1 to 7, the liquid supply pump includes a biasing unit which biases the first flexible member in the direction opposite to the direction where the first flexible member changes when the negative pressure is applied to the negative pressure chamber, and the pressure adjustor changes a volume for at least a part of the increase volume after the negative pressure is released when a negative pressure which is higher than a biasing force by the biasing unit is applied to the negative pressure chamber. According to the liquid supply apparatus of the application example 8, the valve body is biased by the biasing unit in the direction opposite to the change direction. Accordingly, the liquid supply pressure is defined only by the pressing force by the biasing unit. Therefore, the supply pressure of liquid can be more stable. Further, the deterioration due to large deformation of the valve body can be suppressed by providing the biasing unit.

APPLICATION EXAMPLE 9

A liquid ejecting apparatus includes the liquid supply apparatus according to any one of the application examples 1 to 8, and an ejecting unit which ejects liquid supplied from the liquid supply apparatus. According to the liquid ejecting apparatus of the application example 9, since the liquid is supplied at a stable supply pressure, the entire liquid ejecting apparatus can be suppressed from being damaged due to excessive pressure.

In the invention, the above aspects can be applied by appropriately combining the aspects or eliminating a part of the aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

A1. Apparatus Configuration

Figure 1:
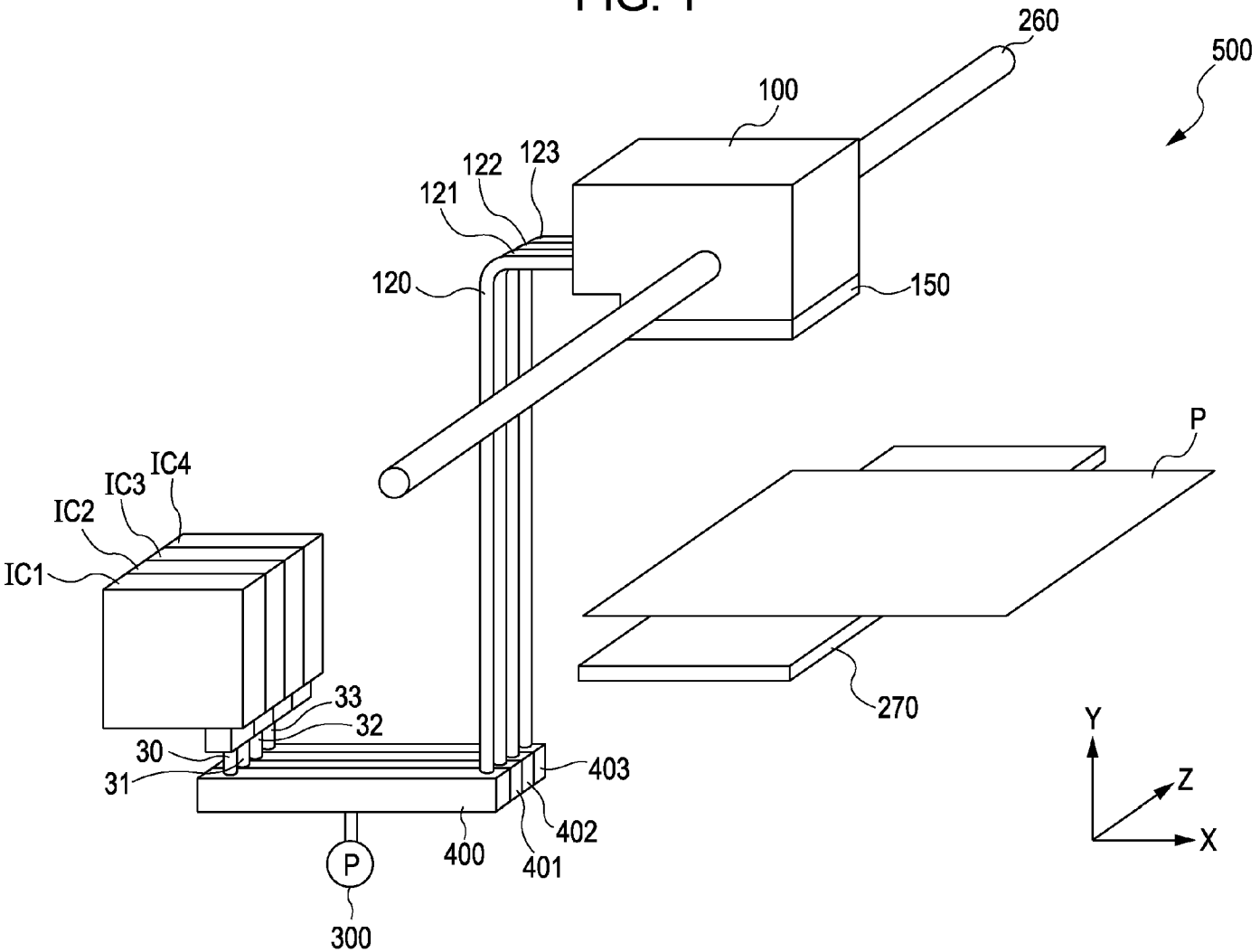
FIG. 1 is a descriptive view illustrating a schematic configuration of a printer as a liquid ejecting apparatus according to a first embodiment of the invention.

FIG. 1 is a descriptive view illustrating a schematic configuration of a printer 500 as a liquid ejecting apparatus according to the first embodiment of the invention. The printer 500 according to the first embodiment is an ink jet printer capable of discharging inks of four colors (black, cyan, magenta, yellow). The printer 500 includes an ink cartridge IC1 containing the black ink, an ink cartridge IC2 containing the cyan ink, an ink cartridge IC3 containing the magenta ink, an ink cartridge IC4 containing the yellow ink, a carriage 100, a recording head 150 as an example of an ejecting unit which ejects liquid, a guide rod 260, a platen 270, four ink supply units 400, 401, 402, 403, four ink introducing tubes 30, 31, 32, 33, four pipings 120, 121, 122, 123 and a negative pressure generation unit 300. It is noted that what a pressure is "large" or "small" expresses what an absolute value of the pressure is "large" or "small".

The printer 500 is a so-called off carriage type printer in which the four ink cartridges IC1 to IC4 are mounted on a printer main body side. The ink cartridge IC1 is connected to the carriage 100 through the ink introducing tube 30, the ink supply unit 400 and the piping 120. Similarly, the ink cartridge IC2 is connected to the carriage 100 through the ink introducing tube 31, the ink supply unit 401 and the piping 121. The ink cartridge IC3 is connected to the carriage 100 through the ink introducing tube 32, the ink supply unit 402 and the piping 122. The ink cartridge IC4 is connected to the carriage 100 through the ink introducing tube 33, the ink supply unit 403 and the piping 123. The ink cartridges IC1 to IC4 are mounted on a main body frame (not shown) of the printer 500 with a cartridge holder (not shown).

The ink supply unit 400 supplies the black ink contained in the ink cartridge IC1 to the carriage 100 through the piping 120. Similarly, the ink supply unit 401 supplies the cyan ink contained in the ink cartridge IC2 to the carriage 100 through the piping 121. The ink supply unit 402 supplies the magenta ink contained in the ink cartridge IC3 to the carriage 100 through the piping 122. The ink supply unit 403 supplies the yellow ink contained in the ink cartridge IC4 to the carriage 100 through the piping 123.

The negative pressure generation unit 300 is connected to the four ink supply units 400 to 403. These ink supply units 400 to 403 supply each color ink to the carriage 100 by using the negative pressure generation unit 300. Ink flow paths and negative pressure supply paths (not shown) are provided in each of the four pipings 120 to 123.

The guide rod 260 is arranged along a longitudinal direction (z axis) of the platen 270 above (+Y direction) the platen 270. The carriage 100 is supported along the guide rod 260 in a reciprocatable manner in the z axis direction. Further, the carriage 100 is driven by a carriage motor (not shown) through a timing belt (not shown). The recording head 150 is arranged on the bottom of the carriage 100 so as to discharge ink droplets from a number of nozzles (not shown) in the −Y direction along with a reciprocating motion of the carriage 100. At this time, a recording sheet P is transported in the +X direction on the platen 270 by a sheet feeding mechanism (not shown) so that an image or the like is formed on the recording sheet P.

Figure 2:
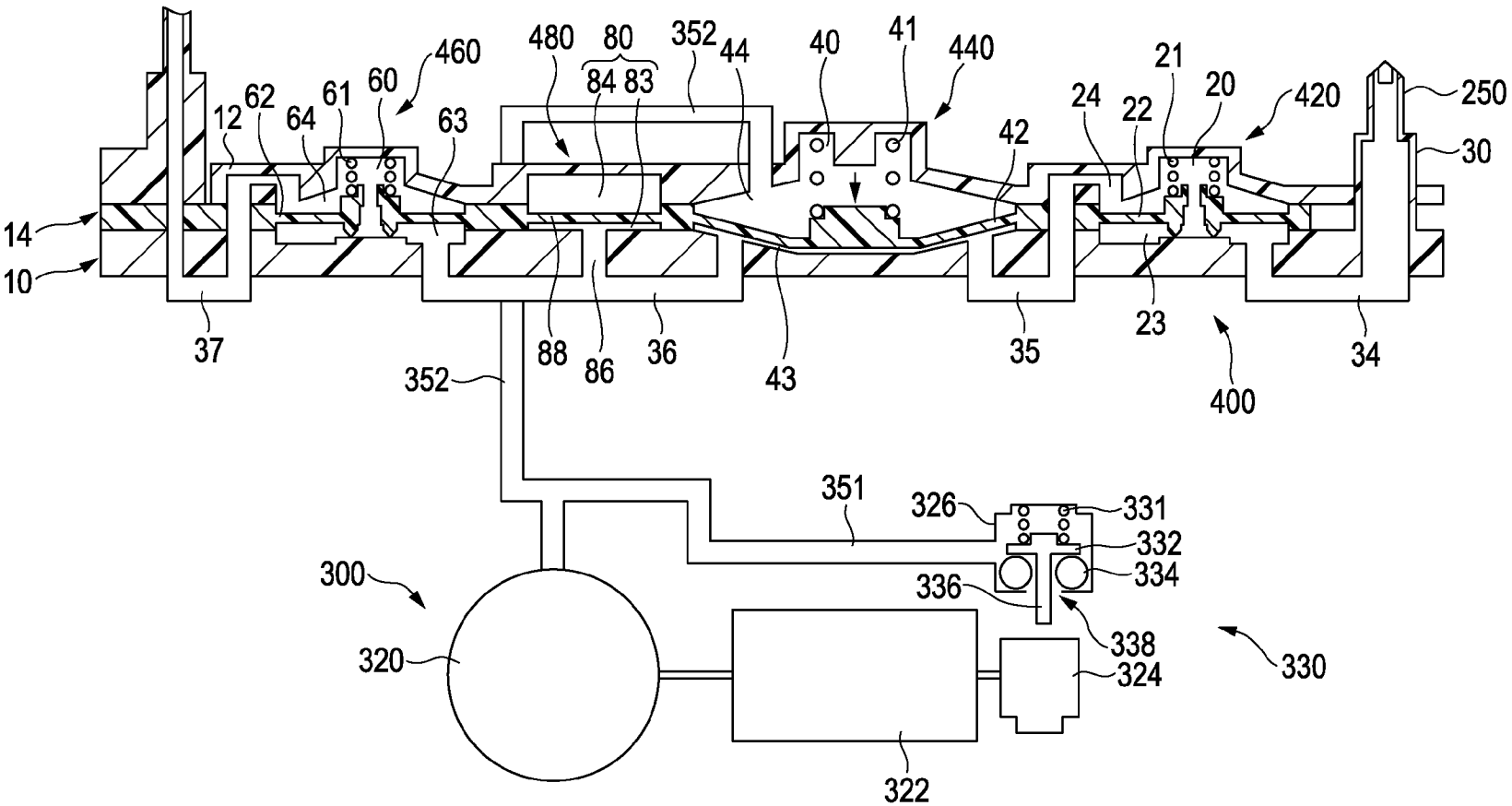
FIG. 2 is a cross-sectional view illustrating an internal configuration of the printer shown in FIG. 1.

FIG. 2 is a cross-sectional view illustrating an internal configuration of the printer 500 shown in FIG. 1. FIG. 2 is a view illustrating the internal configuration when the black ink is supplied. However, internal configurations when other inks are supplied are the same as that in FIG. 2. A relative positional relationship between the carriage 100 and the ink cartridge IC1 and orientations of the carriage 100 and the ink cartridge IC1 in FIG. 2 are different from those in FIG. 1 for the purpose of convenience of illustration.

The ink supply unit 400 includes a first flow path forming member 10, a second flow path forming member 12 and a flexible member 14. Each of the first flow path forming member 10 and the second flow path forming member 12 is a single member made of resin. The flexible member 14 is a single plate-like member made of rubber. The first flow path forming member 10, the second flow path forming member 12 and the flexible member 14 are laminated. Members made of metals may be also used as the first flow path forming member 10 and the second flow path forming member 12. A member made of resin may be also used as the flexible member 14. The ink supply unit 400 having such configuration includes a first valve 420, a second valve 460, a pump 440, and a pressure adjusting unit 480. The first valve 420, the second valve 460, the pump 440 and the pressure adjusting unit 480 in the first embodiment correspond to a "first directional valve", a "second directional valve", a "liquid supply pump" and a "pressure adjustor", respectively, in aspects of the invention.

The first valve 420 includes a first valve chamber 20, a valve body 22 and a coil spring 21. The first valve chamber 20 is a convex-shape space formed between the first flow path forming member 10 and the second flow path forming member 12. The valve body 22 is arranged in the first valve chamber 20 to form a lower space 23 and an upper space 24 in the first valve chamber 20. The valve body 22 is configured as a part of the flexible member 14 and can be displaced in the first valve chamber 20 in the vertical direction. The valve body 22 is pressed to the first flow path forming member 10 with a biasing force of the coil spring 21 in a state where ink is not supplied. Such state is a valve-closed state in which the first valve 420 stops ink flown from the ink cartridge IC1 to the pump 440. On the other hand, when the valve body 22 is displaced upward, a communicating hole is formed at the center portion of the valve body 22 so that the valve body 22 is in a valve-opened state. Therefore, the first valve 420 makes ink flow. The upper space 24 communicates with an internal flow path 35. Further, the internal flow path 35 is an ink flow path connecting the first valve chamber 20 and a pump chamber 40 which will be described later. The lower space 23 communicates with an internal flow path 34. Further, the internal flow path 34 is an ink flow path connecting the ink introducing tube 30 and the first valve chamber 20. In this case, the ink introducing tube 30 is connected to the ink cartridge IC1.

The pump 440 includes a pump chamber 40, a diaphragm 42 and a coil spring 41. The pump chamber 40 is a convex-shape space formed between the first flow path forming member 10 and the second flow path forming member 12, similarly to the above-described first valve chamber 20. The diaphragm 42 is arranged in the pump chamber 40 and divides the pump chamber 40 into a lower space 43 and an upper space 44. The diaphragm 42 is configured as a part of the flexible member 14 and can be displaced in the pump chamber 40 in the vertical direction. When the diaphragm 42 is displaced upward, ink is sucked from the ink cartridge IC1 through the first valve 420. In contrast, when the diaphragm 42 is displaced downward, the ink is supplied to the carriage 100 through the second valve 460. In FIG. 2, the diaphragm 42 is located at the lowermost position (bottom dead point). The lower space 43 communicates with the two internal flow paths 35, 36. Note that the internal flow path 36 is an ink flow path connecting the pump chamber 40 and a second valve chamber 60 which will be described later. The upper space 44 is connected to a negative pressure supply path 352 which will be described later. The diaphragm 42, the lower space 43 and the upper space 44 in the first embodiment of the invention correspond to a "first flexible member", a "pump chamber" and a "negative pressure chamber", respectively of the liquid supply pump in aspects of the invention.

The second valve 460 includes a second valve chamber 60, a valve body 62, and a coil spring 61. The second valve chamber 60 is a convex-shape space formed between the first flow path forming member 10 and the second flow path forming member 12, similarly to the above-described first valve chamber 20. The valve body 62 is arranged in the second valve chamber 60. Further, the valve body 62 forming a lower space 63 and an upper space 64 in the second valve chamber 60 is configured as a part of the flexible member 14 and can be displaced in the second valve chamber 60 in the vertical direction. The valve body 62 is pressed to the first flow path forming member 10 with the biasing force of the coil spring 61 in a state where ink is not supplied. Such state is a valve-closed state in which the second valve 460 stops ink flown from the pump 440 to the piping 120 (carriage 100). On the other hand, when the valve body 62 receives a pressure equal to or larger than a predetermined pressure (for example, 4 kpa) at an upper portion thereof by ink in the internal flow path 36, the valve body 62 is displaced upward so as to be in a valve-opened sate. At this time, the second valve 460 makes ink flow. The lower space 63 communicates with the internal flow paths 36, 37.

The pressure adjusting unit 480 includes a pressure adjusting chamber 80, a communicating path 86 and a volume change member 88. The pressure adjusting unit 480 adjusts a supply pressure of ink output from the pump 440 and supplied to the recording head 150 through the second valve 460. The pressure adjusting chamber 80 is a convex-shape space formed between the first flow path forming member 10 and the second flow path forming member 12. The communicating path 86 connects the internal flow path 36 and the pressure adjusting chamber 80. The volume change member 88 is configured as a part of the flexible member 14 and provided in the pressure adjusting chamber 80. In addition, the volume change member 88 forms a lower space 83 and an upper space 84 in the pressure adjusting chamber 80. Hereinafter, the volume change member 88 is referred to as the volume change member 88. The volume change member 88 can be displaced in the pressure adjusting chamber 80 in the vertical direction. When a negative pressure is supplied to the pump 440, the diaphragm 42 is displaced upward, and the volume of the lower space 43 increases to a volume larger than a predetermined volume, the volume change member 88 operates as follows. That is to say, after the negative pressure is released, the volume change member 88 bends upward by the ink flown into the pressure adjusting chamber 80 through the internal flow path 36 and the communicating path 86. Then, the volume change member 88 changes the volume of the lower space 83 by an increase volume which is a volume difference between the changed volume and the predetermined volume of the lower space 43. An operation of the pressure adjusting unit 480 will be described later in detail. The pressure adjusting chamber 80, the communicating path 86 and the volume change member 88 in the first embodiment of the invention correspond to a "pressure adjusting chamber", a "connector" and a "volume change member (second flexible member)", respectively in aspects of the invention.

The negative pressure generation unit 300 includes a driving motor 322, a suction pump 320, a cam mechanism 324 and an atmosphere releasing mechanism 330. The suction pump 320 is connected to the driving motor 322. Further, the suction pump 320 is connected to the negative pressure supply path 352. The driving motor 322 is connected to the suction pump 320 and the cam mechanism 324 and drives the suction pump 320 and the cam mechanism 324. The atmosphere releasing mechanism 330 includes a housing 326, a coil spring 331, a valve body 332 and a sealing member 334. The housing 326 is connected to the negative pressure supply path 352 through a piping 351. Further, an opening 338 is provided on the housing 326 and a rod 336 is inserted from the opening 338. Spaces are provided between the opening 338 and the inserted rod 336. The rod 336 is bonded to the valve body 332 in the inner portion of the housing 326. The coil spring 331 is biased in the direction where the valve body 332 is pressed to the sealing member 334. The above-described driving motor 322 can be driven in a forward rotational direction and a backward rotational direction. The suction pump 320 is driven by the forward rotational driving of the driving motor 322 so as to generate a negative pressure. On the other hand, the cam mechanism 324 is driven by the backward rotational driving of the driving motor 322 so as to push the rod 336 out. At this time, the valve body 332 is pushed up so as to be separated from the sealing member 334. Therefore, the atmosphere in the housing 326 is released and the atmosphere in the negative pressure supply path 352 is also released.

A2. Ink Supply Operation in Ink Supply Unit 400

Generally, at the time of suction driving executed by the pump 440 when ink is supplied, if a negative pressure equivalent to a pressure generated by a biasing force of the coil spring 41 is supplied to the pump 440, the diaphragm 42 is elastically deformed by overcoming the pressure generated by the biasing force of the coil spring 41. Accordingly, the diaphragm 42 is displaced upward to abut against a stopper 45 and stops. In this case, the volume of the lower space 43 corresponds to a volume C1 which is defined in advance (hereinafter, referred to as a predetermined volume C1). Then, when the negative pressure is released to communicate with the atmosphere, the diaphragm 42 is pressurized only by the biasing force of the coil spring 41. Accordingly, the diaphragm 42 descends so that ink is supplied from the lower space 43. A supply pressure of ink supplied in this manner is substantially equal to a pressure generated by the biasing force of the coil spring 41. In the first embodiment of the invention, the supply pressure of ink, which is defined only by the biasing force of the coil spring 41, is a target supply pressure P4 of the ink output from the pump 440. However, a variation is generated in the negative pressure supplied to the pump 440 by the negative pressure generation unit 300 due to differences in the set environment (difference in elevation) and the like. For example, when the negative pressure is lower than the pressure generated by the biasing force of the coil spring, a problem that a supply pressure of ink cannot be sufficiently obtained arises. Accordingly, in the first embodiment of the invention, a negative pressure P2 (for example, −50 kpa) which is larger than a pressure P1 (for example, 30 kpa) generated by the biasing force of the coil spring is supplied to the pump 440 in consideration of the variation of the negative pressure. Therefore, a supply pressure P3 of ink is prevented from being lower than the target supply pressure P4.

Figure 3A:
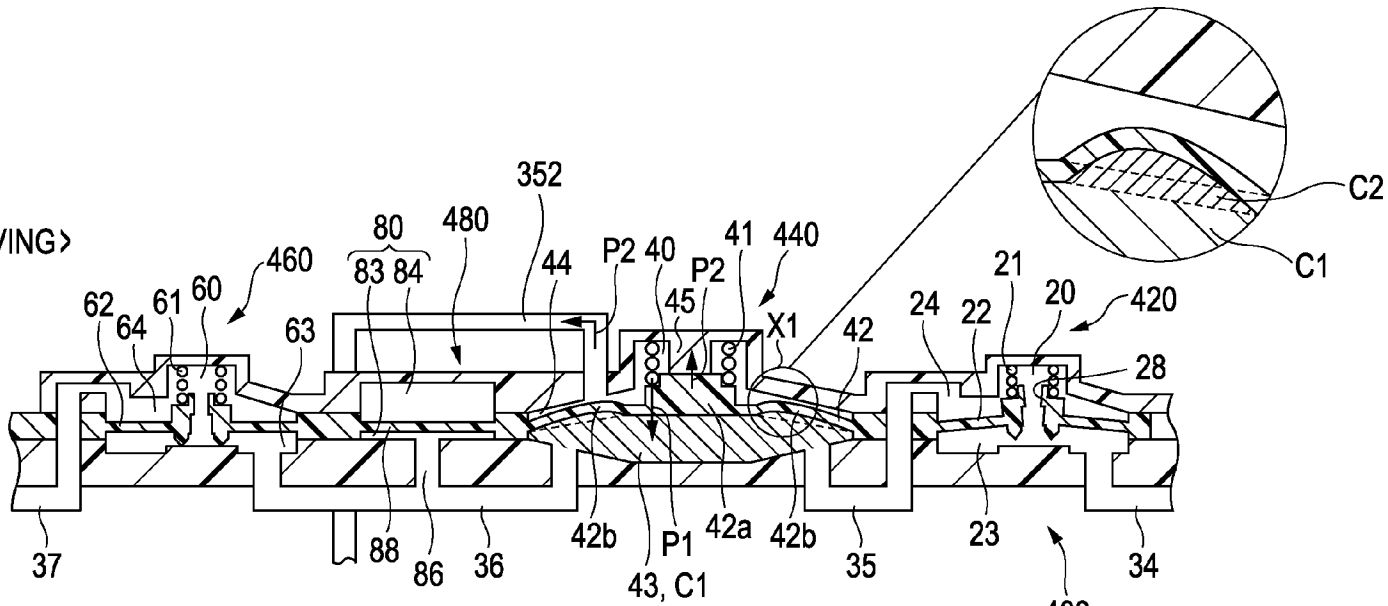
FIGS. 3A and 3B are descriptive views explaining an ink supply operation according to the first embodiment of the invention.
Figure 3B:
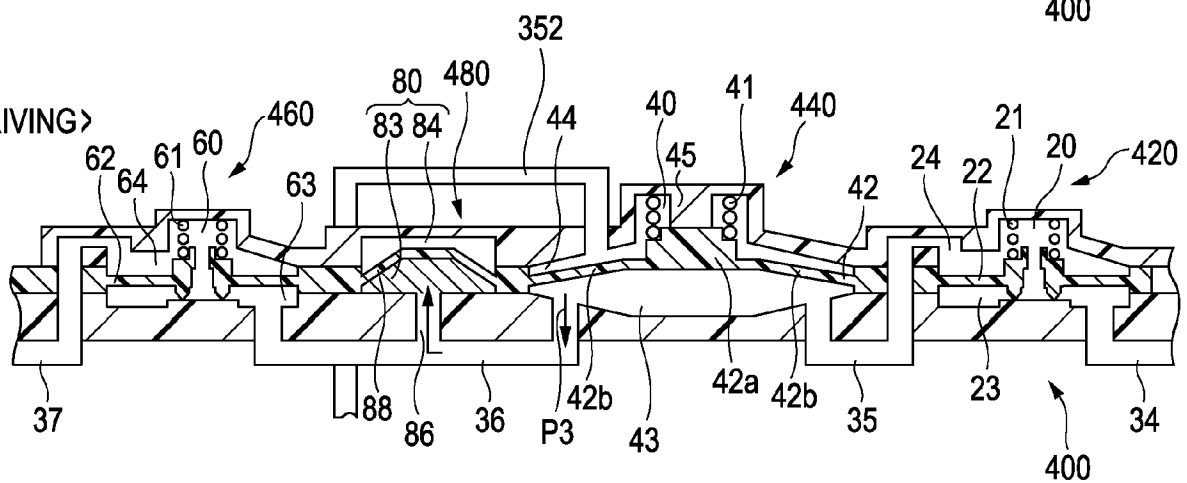
Figure 4:
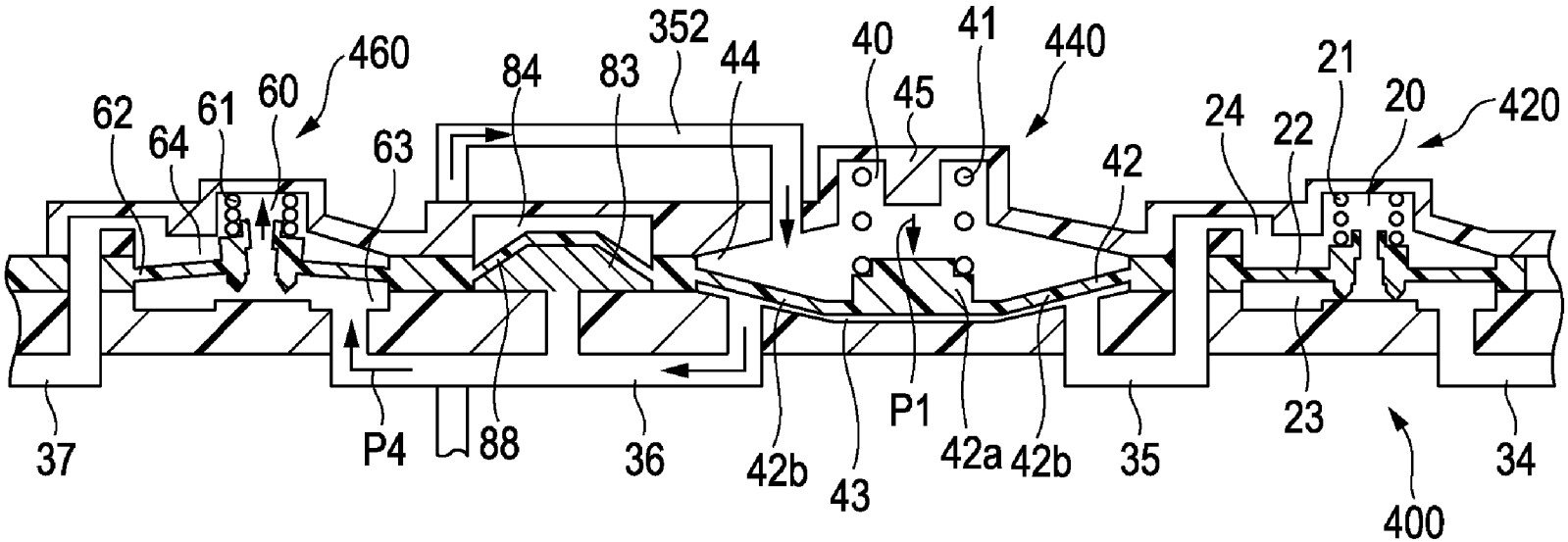
FIG. 4 is a descriptive view explaining an ink supply operation according to the first embodiment of the invention.

FIGS. 3A, 3B and 4 are descriptive views explaining an ink supply operation according to the first embodiment of the invention. FIG. 3A is a cross-sectional view illustrating the ink supply unit 400 at the time of ink suction driving. FIGS. 3B and 4 are cross-sectional views illustrating the ink supply unit 400 at the time of ink discharge driving. When ink is supplied to the recording head 150 from the state as shown in FIG. 2, the pump 440 firstly executes the ink suction driving from the ink cartridge IC1.

To be more specific, the driving motor 322 (FIG. 2) is driven in the forward rotation direction so as to drive the suction pump 320. Then, the suction pump 320 generates a negative pressure so as to supply the negative pressure P2 to the upper space 44 of the pump 440 through the negative pressure supply path 352 (FIG. 3A). When a pressure within the upper space 44 is a negative pressure, the diaphragm 42 is elastically deformed by overcoming the pressure P1 generated by the biasing force of the coil spring 41. Accordingly, the diaphragm 42 is displaced upward to abut against the stopper and stops. As shown in FIG. 3A, the volume of the lower space 43 increases in accordance with the displacement of the diaphragm 42. At this time, since the pressure within the lower space 43 is a negative pressure, the pump 440 executes the suction operation. In other words, the pump 440 sucks ink in the upper space 24 of the first valve 420 through the internal flow path 35. In the first valve 420, the valve body 22 is elastically deformed by overcoming the biasing force of the coil spring 21. Accordingly, the valve body 22 is displaced upward. At this time, a communicating hole 28 which communicates the upper space 24 with the lower space 23 is formed on the center portion of the valve body 22 so that the first valve 420 is in the valve-opened state. Accordingly, the black ink contained in the ink cartridge IC1 (FIG. 2) is sucked into the lower space 43 of the pump 440 through an ink introduction needle 250 (FIG. 2), the ink introducing tube 30 (FIG. 2), the internal flow path 34, the lower space 23, the communicating hole 28, the upper space 24 and the internal flow path 35. Note that the volume of the pump 440 has increased at this time.

Since the negative pressure P2 which is larger than the pressure P1 generated by the biasing force of the spring is supplied to the pump 440, a negative pressure which is larger than the pressure P1 generated by the biasing force is supplied to the pump 440. Hereinafter, a case where the diaphragm 42 is sucked while the supplied negative pressure P2 is kept is described as an example. The description below can be also applied to a case where the diaphragm 42 is sucked at a negative pressure which is larger than the pressure P1 generated by the biasing force even if the negative pressure is lower than the negative pressure P2.

When the negative pressure P2 is supplied to the pump 440, the pressure within the upper space 44 becomes a negative pressure so that the diaphragm 42 is displaced upward. Further, after the center portion 42*a* of the diaphragm 42 abuts against the stopper 45, outer edges 42*b* of the diaphragm 42 are displaced upward by the negative pressure as shown by an enlarged view in a circle X1 of FIG. 3A and stop the displacement at a position where the diaphragm 42 balances with the negative pressure P2. As a result, the volume of the lower space 43 is expressed by the predetermined volume C1+an increase volume C2 (a volume corresponding to a shaded hatching portion in the circle X1). It is to be noted that a shape of the outer edge 42*b* when the volume of the lower space 43 is the predetermined volume C1 is shown with dashed lines in the circle X1.

On the other hand, at the time of suction driving executed by the pump 440, ink in the lower space 63 is sucked into the pump 440 through the internal flow path 36 in the second valve 460. Accordingly, the valve body 62 keeps a state of being pushed to the first flow path forming member 10 (valve-closed state).

After the lower space 43 of the pump chamber 40 is filled with ink whose volume corresponds to the predetermined volume C1+the increase volume C2 by the above suction driving, the atmosphere in the upper space 44 is released. Then, the pump 440 executes the discharge driving of ink. To be more specific, the driving motor 322 (FIG. 2) drives the cam mechanism 324 by the backward rotation driving. Then, the rod 336 is pushed and the valve body 332 goes up so as to be in the valve-opened state. Therefore, the piping 351 communicates with the atmosphere through the opening 338. At this time, the atmosphere in the upper space 44 is released through the negative pressure supply path 352 (FIG. 3B), and the outer edges 42*b* of the diaphragm 42 which are displaced upward descend. Since the diaphragm 42 is balanced by pulling with the negative pressure P2, the diaphragm 42 descends while pressurizing ink in the lower space 43 at the pressure P2 equivalent to the negative pressure immediately after the atmosphere in the upper space 44 is released. That is to say, the ink filled in the lower space 43 is discharged to the internal flow path 36 at the supply pressure P3 (=negative pressure P2). The ink discharged from the lower space 43 to the internal flow path 36 flows into the lower space 83 of the pressure adjusting chamber 80 through the communicating path 86. The volume change member 88 is pressurized by the ink flown into the lower space 83 and bends in the direction of the upper space 84 (upward in FIG. 3B) from the direction of the lower space 83. Therefore, the volume of the lower space 83 expands. The ink is contained in the lower space 83.

If the outer edges 42*b* of the diaphragm 42 continue to descend and the volume of the lower space 43 becomes the predetermined volume C1, the diaphragm 42 is elastically deformed (displaced) downward only by the pressure P1 generated by the biasing force of the coil spring 41, as shown in FIG. 4. At this time, the ink filled in the lower space 43 is discharged to the internal flow paths 35, 36 at the target supply pressure P4 which is substantially equal to the pressure P1 generated by the biasing force of the coil spring by the displacement of the diaphragm 42. That is to say, the supply pressure of the ink gradually changes from P3 to P4 after the negative pressure is released. The pressurizing ink discharged to the internal flow path 36 from the lower space 43 pushes up the valve body 62 from the lower side with a predetermined supply pressure P4 in the second valve 460. Then, the valve body 62 is displaced upward by overcoming the pressure (for example, 4 kpa) generated by the biasing force of the coil spring 61 so as to be in the valve-opened state. Therefore, the ink flown into the lower space 63 is discharged toward the carriage 100 through the internal flow path 37.

On the other hand, in the first valve 420, the pressurized ink flows into the upper space 24 through the internal flow path 35. Then, the pressure generated by the biasing force of the coil spring 21 and the pressure of the flown ink make the valve body 22 displace downward. Further, the communicating hole 28 formed at the center portion of the valve body 22 disappears so that the upper space 24 doesn't communicate with the lower space 23. Accordingly, the pressurized ink which is discharged from the lower space 43 along with the discharge driving of the pump 440 is suppressed from being reversely flown to the ink cartridge IC1 through the first valve 420.

The volume change member 88 is configured to change (bend) when ink is flown into the lower space 83 at a pressure which is higher than the pressure P1 generated by the biasing force. With this configuration, ink supplied from the lower space 43 at a pressure higher than the pressure P1 generated by the biasing force, that is, ink of which volume corresponds to the increase volume C2 is temporarily contained in the lower space 83 of the pressure adjusting unit 480 after the negative pressure is released. As a result, the expansion of the outer edges 42*b* of the diaphragm 42 is released, and the diaphragm 42 is pressurized downward only by the pressure P1 generated by the biasing force of the coil spring 41. Therefore, the supply pressure of ink output from the lower space 43 becomes the desired pressure P4 (=pressure P1 generated by the biasing force). In this case, the volume change member 88 descends in accordance with the suction driving of the diaphragm 42. The ink contained in the lower space 83 is returned to the internal flow path 36 through the communicating path 86 along with the descent of the volume change member 88.

When ink is ejected from the recording head 150 (FIG. 1), ink of which amount corresponds to an ink amount consumed by the ejection is supplied to the recording head 150, as will be described later. Further, ink of which amount corresponds to the ink amount consumed by the ejection is supplied to the carriage 100 by the pump 440 (FIG. 3B). At this time, the ink is supplied in a state where the ink is pressurized by the downward pressing force of the diaphragm 42 (pressing force generated by the biasing force of the coil spring 41). Then, when the diaphragm 42 is displaced to the bottom dead point as the ink is supplied, the driving motor 322 drives in the forward rotational direction again. Then, the pump 440 executes the above suction operation and the discharge driving. In such a manner, ink of which amount corresponds to an ink amount consumed by the ejection is appropriately supplied from the ink cartridge IC1 to the recording head 150 in a pressurized state. It is to be noted that some pressure loss is caused in the supply pressure of ink in the course where the ink is supplied from the pump 440 to the recording head 150.

According to the printer 500 in the first embodiment of the invention as described above, the pressure adjusting unit 480 as a pressure adjuster is provided. The pressure adjusting unit 480 adjusts the supply pressure of ink to be supplied to the recording head 150 by changing a volume of a predetermined portion (lower space 83 of the pressure adjusting chamber 80) between the first valve 420 and the second valve 460 by the increase volume C2 after the negative pressure supplied to the diaphragm 42 is released. Accordingly, when the diaphragm 42 is deformed by being sucked by the negative pressure, and the volume of the lower space 43 becomes a volume larger than the predetermined volume C1, if the deformation of the diaphragm 42 starts to be tuned back to an original state by releasing the negative pressure, the following operation is performed. That is to say, first, the volume of the lower space 83 of the pressure adjusting unit 480 is expansion-changed by a volume of which amount corresponds to a volume increased when the diaphragm 42 is deformed, that is, the increase volume C2 which is a difference in volume between the expanded volume and the predetermined volume C1. Thereafter, the supply pressure of the ink is defined only by the pressing force generated when the diaphragm 42 turns back to the original state (biasing force of the coil spring 41) so that the ink is supplied to the recording head 150. Therefore, since the pressure of liquid to be supplied to the recording head 150 is defined only by the descent of the diaphragm 42 (biasing force of the coil spring 41), the liquid can be supplied to the recording head 150 at a stable supply pressure. Further, ink is flown into the downstream side of the pressure adjusting unit 480 at the target supply pressure P4. Therefore, although components constituting the ink supply unit 400, in particular, joint portions of the internal flow paths are vulnerable to the pressure, such components including the joint portions can be prevented from being damaged.

According to the printer 500 in the first embodiment of the invention, the pressure adjusting unit 480 includes the pressure adjusting chamber 80 connected to the internal flow path 36, and the volume change member 88 dividing the pressure adjusting chamber 80 into the lower space 83 and the upper space 84. The pressure adjusting unit 480 changes the volume of the lower space 83 by the increase volume C2 after the negative pressure is released. Accordingly, the supply pressure of ink can be adjusted only by adding the pressure adjusting unit 480 without largely changing the configuration of the existing ink supply unit 400. Moreover, since a flexible member is used as the volume change member 88, the volume of the lower space 83 can be changed with a simple configuration.

Further, according to the printer 500 in the first embodiment of the invention, the volume change member 88 is formed with the same material as the diaphragm 42. Accordingly, the volume change member 88 of the pressure adjusting unit 480 can be integrally formed with the diaphragm 42. Therefore, the pressure adjusting unit 480 can be easily formed.

Ink can be suppressed from being supplied at a high supply pressure by changing the volume by at least a part of the volume not for all the increase volume C2.

B. Second Embodiment

In the second embodiment, a part of the internal flow path is formed with a flexible member as a pressure adjustor which adjusts a supply pressure of ink output from the pump 440.

B1. Ink Supply Operation in Ink Supply Unit 400

Figure 5A:
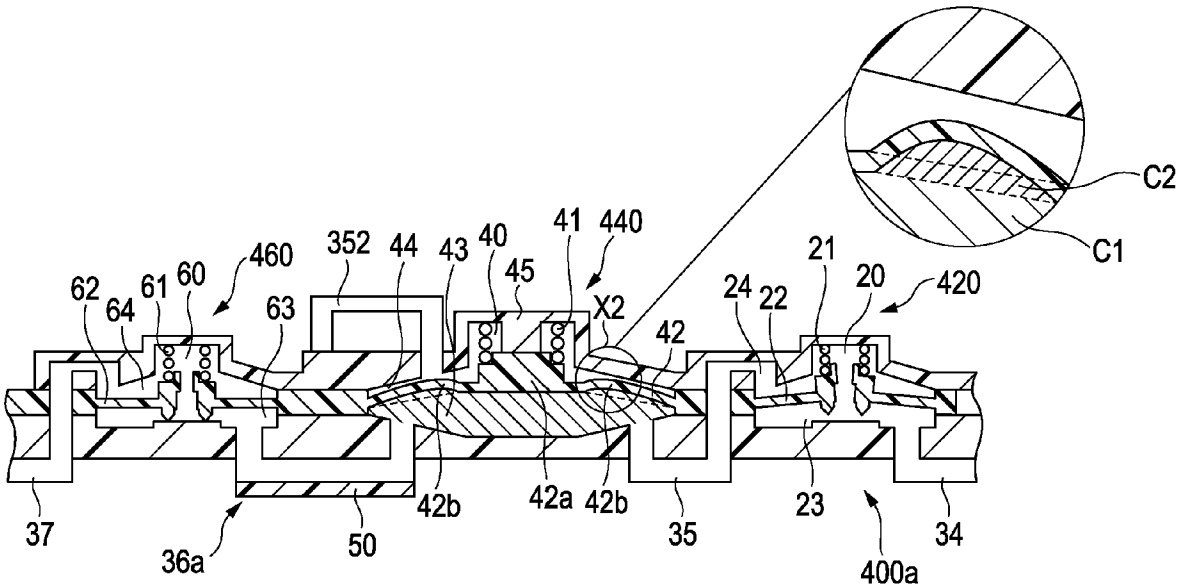
FIGS. 5A and 5B are descriptive views explaining an ink supply operation according to a second embodiment of the invention.
Figure 5B:
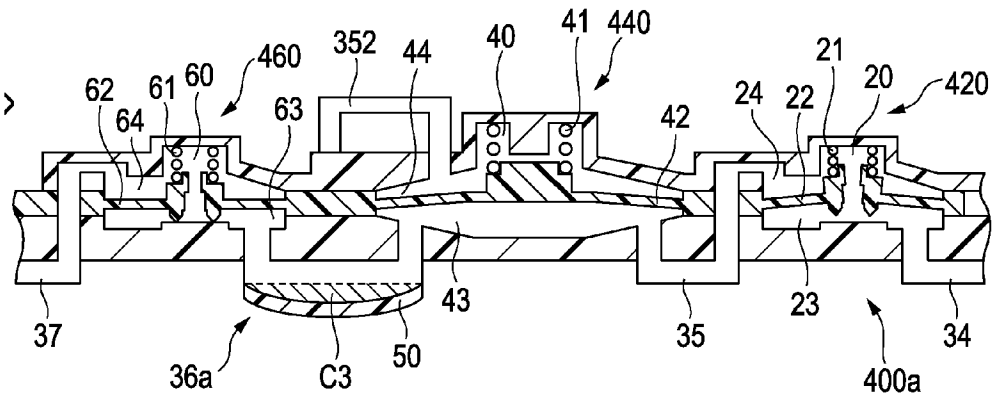

FIGS. 5A and 5B are descriptive views explaining an ink supply operation according to the second embodiment of the invention. In an ink supply unit 400*a*, the internal flow path 35, the first valve 420, the pump 440 and the second valve 460 have the same configurations as those in the first embodiment. A flexible member 50 is provided at the internal flow path 36 so as to constitute a part of the internal flow path 36. The flexible member 50 in the second embodiment corresponds to a "third flexible member" in an aspect of the invention. The flexible member 50 may be formed with a film or a rubber. The flexible member 50 may be attached to a flow path substrate constituting the internal flow path 36 so as to cover at least a part of the internal flow path 36. Further, the flexible member 50 is formed so as to bend in the direction where the volume of the internal flow path 36 expands (downward in FIGS. 5A and 5B) by the pressure P1 generated by the biasing force of the coil spring 41.

As in the first embodiment, a case where the diaphragm 42 is sucked while the supplied negative pressure P2 is kept is described as an example. When the negative pressure P2 is supplied to the pump 440, the outer edges 42*b* of the diaphragm 42 are displaced upward by the negative pressure P2 and stop the displacement at a position where the diaphragm 42 balances with the negative pressure P2 as described in the first embodiment with reference to FIG. 3A. As a result, the volume of the lower space 43 is expressed by the predetermined volume C1+the increase volume C2 (a volume corresponding to a shaded hatching portion in a circle X2). It is to be noted that a shape of the outer edge 42*b* when the volume of the lower space 43 is the predetermined volume C1 is shown with dashed lines in the circle X2.

When the atmosphere in the upper space 44 is released through the negative pressure supply path 352, the outer edges 42*b* of the diaphragm 42 which are displaced upward descend, first. Since the diaphragm 42 is balanced by pulling with the negative pressure P2, the ink filled in the lower space 43 is supplied to the internal flow path 36 at the supply pressure P3 (=negative pressure P2) as in the first embodiment. When the ink is supplied to the internal flow path 36 at the supply pressure P3 higher than the pressure P1 generated by the biasing force, the flexible member 50 bends and the volume of the internal flow path 36 expands by the volume C3 as shown in FIG. 5B. The volume C3 is the substantially same as the increase volume C2.

If the outer edges 42*b* of the diaphragm 42 continue to descend and the volume of the lower space 43 becomes the predetermined volume C1, the diaphragm 42 is elastically deformed (displaced) downward only by the pressure P1 generated by the biasing force of the coil spring 41, as shown in FIG. 5B. Along with the deformation, ink is discharged to the internal flow paths 35, 36 at the target supply pressure P4 which is substantially equal to the pressure P1 generated by the biasing force of the coil spring 41 from the lower space 43, and supplied to the recording head 150.

According to the printer 500 in the second embodiment of the invention as described above, the flexible member 50 as a pressure adjustor is provided so as to form a part of the ink supply unit 400, more particularly a part of the internal flow path 36. Accordingly, after the negative pressure is released, the volume of the internal flow path 36 can be expansion-changed by the increase volume C2 of the lower space 43 of the first valve 420. As a result, ink can be supplied to the recording head 150 at a stable supply pressure while suppressing the number of components constituting the internal flow path.

C. Third Embodiment

In the third embodiment, a portion which easily bends is provided on the valve body 22 of the first valve 420 as a pressure adjustor which adjusts the supply pressure of ink output from the pump 440.

C1. Ink Supply Operation in Ink Supply Unit 400

Figure 6A:
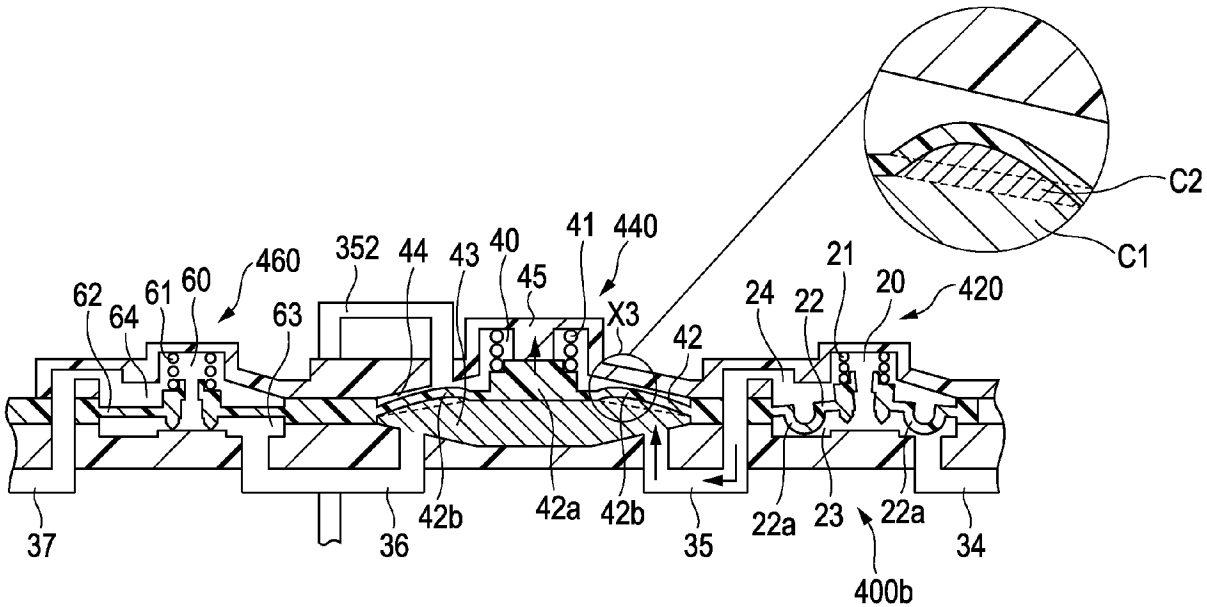
FIGS. 6A and 6B are descriptive views explaining an ink supply operation according to a third embodiment of the invention.
Figure 6B:
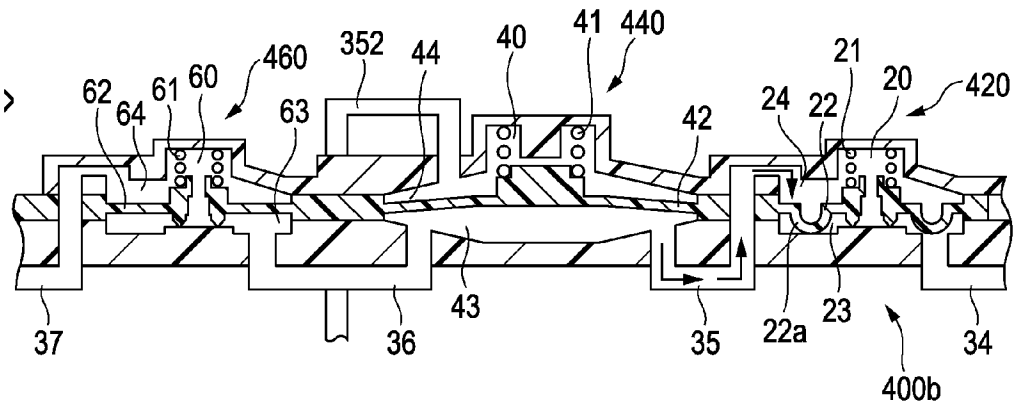

FIGS. 6A and 6B are descriptive views explaining an ink supply operation according to the third embodiment of the invention. In an ink supply unit 400*b*, the internal flow path 35, the pump 440 and the second valve 460 have the same configurations as those in the first embodiment. The pressure adjusting unit 480 is not provided and the internal flow path 36 is configured so as to communicate the lower space 43 with the lower space 63 in the third embodiment. The valve body 22 of the first valve 420 includes a bending portion 22*a*. The bending portion 22*a* is configured so as to more easily bend in comparison with the other portions in the valve body 22. In addition, the bending portion 22*a* is configured to easily bend in the valve-closing direction of the first valve 420 (downward in FIGS. 6A and 6B) when the pressure P1 generated by the biasing force is applied.

As in the first embodiment, a case where the diaphragm 42 is sucked while the supplied negative pressure P2 is kept is described as an example. When the negative pressure P2 is supplied to the pump 440, the outer edges 42*b* of the diaphragm 42 are displaced upward by the negative pressure P2 and stop the displacement at a position where the diaphragm 42 balances with the negative pressure P2 as described in the first embodiment with reference to FIG. 3A. As a result, the volume of the lower space 43 is expressed by the predetermined volume C1+the increase volume C2 (a volume corresponding to a shaded hatching portion in a circle X4). It is to be noted that a shape of the outer edge 42*b* when the volume of the lower space 43 is the predetermined volume C1 is shown with dashed lines in the circle X4.

When the atmosphere in the upper space 44 is released through the negative pressure supply path 352, the outer edges 42*b* of the diaphragm 42 which are displaced upward descend, first. Since the diaphragm 42 is balanced by pulling with the negative pressure P2, the ink filled in the lower space 43 is supplied to the internal flow paths 35, 36 at the supply pressure P3 (=negative pressure P2) as in the first embodiment. When the ink is supplied to the internal flow path 35 at the supply pressure P3 higher than the pressure P1 generated by the biasing force, the bending portion 22*a* bends and the volume of the upper space 24 increases as shown in FIG. 6B. In this case, the bending portion 22*a* is preferably formed such that the volume of the upper space 24 increase by a volume which is substantially equal to the increase volume C2. It is to be noted that since the valve body 22 is pressurized in the valve-closing direction by the pressure of ink returned from the pump 440, the first valve 420 never opens.

If the outer edges 42*b* of the diaphragm 42 continue to descend and the volume of the lower space 43 becomes the predetermined volume C1, the diaphragm 42 is elastically deformed (displaced) downward only by the pressure generated by the biasing force of the coil spring 41, as shown in FIG. 5B. Along with the deformation, ink is discharged to the internal flow path 36 at the target supply pressure P4 which is substantially equal to the pressure P1 generated by the biasing force of the coil spring 41 from the lower space 43, and supplied to the recording head 150. In such a manner, the supply pressure of ink is adjusted at a position near the pump 440.

According to the printer in the third embodiment of the invention as described above, the bending portion 22*a* is formed on the first valve 420. Accordingly, after the negative pressure is released, the valve body 22 of the first valve 420 bends and the volume of the upper space 24 can be expansion-changed by the increase volume C2 which is a difference in volume between the expanded volume and the predetermined volume C1. As a result, liquid can be supplied to a liquid ejecting apparatus at a stable supply pressure with a simple configuration while suppressing the number of components constituting the ink supply unit 400.

D. Modifications

Figure 7:
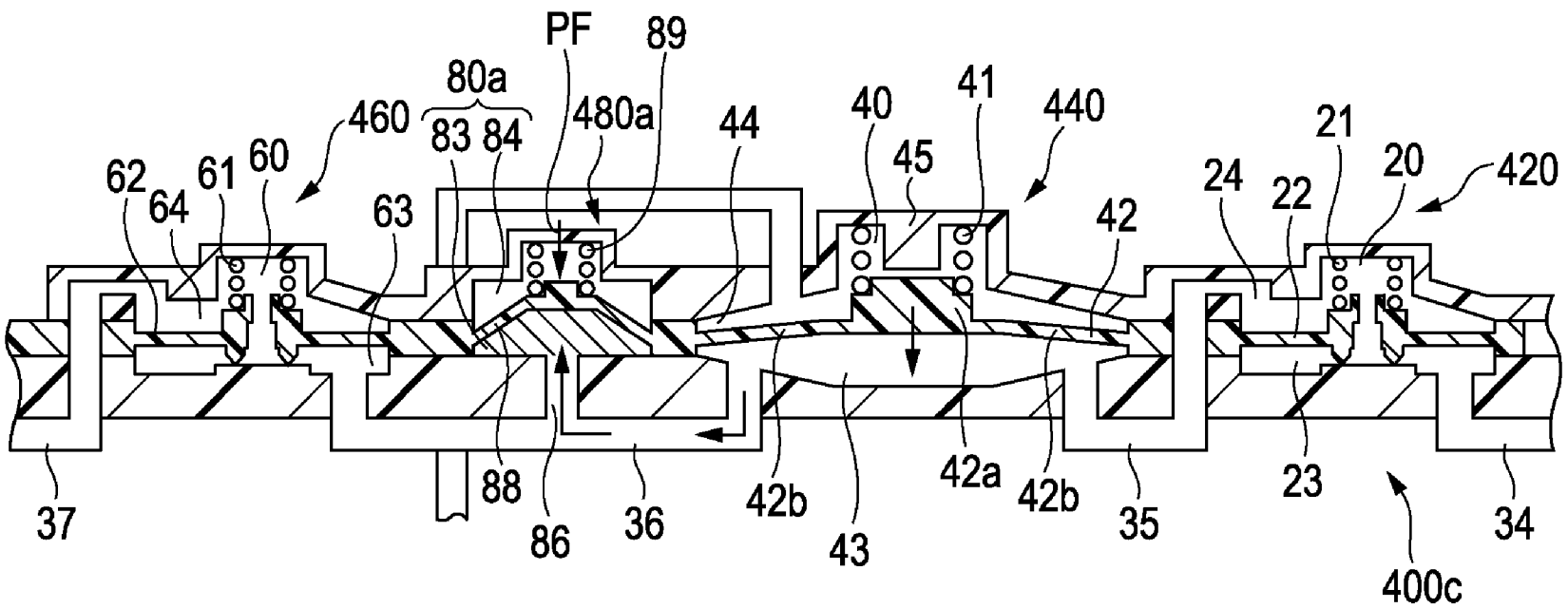
FIG. 7 is a cross-sectional view illustrating an internal configuration of an ink supply unit of the printer according to a modification.

1. Only the volume change member 88 is provided in the pressure adjusting chamber 80 in the first embodiment. However, a coil spring 89 of which biasing force pressurizes the volume change member 88 may be provided in the upper space 84 of the pressure adjusting unit 480. FIG. 7 is a cross-sectional view illustrating an internal configuration of an ink supply unit of the printer according to the modification. In an ink supply unit 400*c* according to the modification, the first valve 420, the pump 440 and the second valve 460 have the same configurations as those in the first embodiment. Further, the pressure adjusting unit 480*a* in the modification has the same configuration as the pressure adjusting unit 480 in the first embodiment except that the coil spring 89 is provided. The coil spring 89 biases the volume change member 88 by a biasing force which generates the pressure equivalent to the pressure P1 generated by the biasing force, for example. This is preferable for the following reasons. If the pressure PF generated by the biasing force of the coil spring 89 is lower than the pressure P1 generated by the biasing force, even when the supply pressure of ink is the target supply pressure P4, the volume change member 88 bends and the target supply pressure is not applied. On the other hand, if the pressure PF generated by the biasing force of the coil spring 89 is higher than the pressure P1 generated by the biasing force and is close to the negative pressure P2 or over the negative pressure P2, the volume of the lower space 83 does not sufficiently increase. Accordingly, in both cases, it is difficult to adjust the supply pressure of ink sufficiently.

According to the modification 1, the coil spring 89 is provided as a biasing unit which biases the volume change member 88. Therefore, the volume change member 88 is biased by the coil spring 89 in the direction opposite to the bending direction of the volume change member 88. This makes it possible to suppress the extreme deformation of the volume change member 88 which is a flexible member.

2. The flexible volume change member 88 is used as a member which divides the pressure adjusting chamber 80 of the pressure adjusting unit 480 and changes the volume of the lower space 83 in the first embodiment. However, a piston may be used in place of the volume change member 88. If the flexible member is repeatedly bended, the flexible member deteriorates so that the effect thereof is reduced. However, the reduction in effect due to the deterioration can be suppressed by using the piston.

3. A film which is the flexible member 50 is provided on one side of the flow path substrates constituting the internal flow path in the second embodiment. However, the film may be also provided on the other side (upper side in FIG. 5) of the flow path substrates or all of the side surfaces constituting the flow path may be formed with the flexible member in a part of the flow path.

4. The pressure adjusting unit 480 and the flexible member 50 as the pressure adjustors may be provided on any positions between the first valve 420 and the second valve 460. For example, both of the bending portion 22*a* and the flexible member 50 may be provided or the pressure adjustor may be provided at three or more positions.

5. In the embodiments as described above, the ink jet printer has been described. However, the invention is not limited thereto, and the invention can be applied to any liquid ejecting apparatuses which eject liquids other than ink. For example, the invention can be applied to image recording apparatuses such as a facsimile machine, color material ejecting heads used in manufacturing the color filters such as a liquid crystal display, electrode material ejecting apparatuses used in forming electrodes such as an organic electro luminescence (EL) display and a field emission display (FED), liquid ejecting apparatuses which eject liquid containing bioorganic compounds used in manufacturing a bio chip, specimen ejecting apparatuses as precision pipettes, lubricant ejecting apparatuses, resin liquid ejecting apparatuses, and the like. Additional examples are liquid ejecting apparatuses which pinpoint-eject lubricants onto precision instruments such as a clock or a camera, liquid ejecting apparatuses which eject transparent resin solutions such as an ultraviolet-curing resin onto a substrate for the purpose of forming a micro semi-spherical lens (optical lens) used in optical communication elements or the like, liquid ejecting apparatuses which eject an acid or alkali etchant solution for etching circuit boards, or the like. Further, the invention can be applied to any one type of the ejecting apparatus among various types of the liquid ejecting apparatuses including liquid ejecting heads or the like which discharge a small amount of liquid droplets.

The phrase "droplets" in the specification expresses liquid-state substances discharged from the above liquid ejecting apparatuses, and includes granular, tear-drop form, and filamented tail form substances. The phrase "liquid" in the specification may be any substances capable of being ejected by the liquid ejecting apparatuses. For example, the substance may be any substance of which state is a liquid phase such as a liquid state of which viscosity is high or low, fluid states such as sol, gel water, inorganic solvents, organic solvents, solutions, liquid-state resins and liquid-state metals (metallic molten solution). Further, not only liquids as one state of the substance but the liquid-state substances including particles of functional materials made of solids such as pigments or metal particles, which are dissolved, dispersed or mixed in solvents, are included. Further, as typical examples of liquids, ink described in the above embodiments, liquid crystal, and the like are included. The ink used herein includes various liquid compositions such as general water-soluble ink, oil-based ink, gel ink, hot-melt ink, and the like.

Although the invention has been shown and described on the basis of the embodiments, the invention is not limited to the embodiments. Various configurations can be made without departing from the spirit and scope of the invention.

What is claimed is:

1. A liquid supply apparatus which supplies liquid from a liquid container containing the liquid to a recording head from which the liquid is ejected comprising:

a liquid supply path which communicates the liquid container with the recording head;

a liquid supply pump which pump-drives when a first flexible member constituting at least a part of an inner surface of a pump chamber is displaced such that a volume of the pump chamber is increased or decreased while a part of the liquid supply path is set as the pump chamber;

a negative pressure chamber which is divided from the pump chamber by the first flexible member and of which volume can be changed;

a pressure reduction unit which applies a negative pressure to the negative pressure chamber;

a first directional valve which is provided at the liquid supply path between the liquid container and the pump chamber and passes the liquid in one direction toward the supply pump from the liquid container;

a second directional valve which is provided at the liquid supply path between the supply pump and the liquid ejecting apparatus and passes the liquid in one direction toward the liquid ejecting apparatus from the supply pump; and a pressure adjustor which is provided at the liquid supply path between the first directional valve and the second directional valve and which increases a volume corresponding to at least a part of an increase volume compared to the predetermined volume of the liquid container when a negative pressure larger than a predetermined liquid supply pressure is applied to the negative pressure chamber.

2. The liquid supply apparatus according to claim 1, wherein the pressure adjustor comprises:

a pressure adjusting chamber which is provided between the supply pump and the second directional valve and has a volume which is at least equal to or larger than the increase volume;

a volume change member which is provided so as to divide the pressure adjusting chamber into a first space and a second space and changes the volume of the first space; and a connector which connects the liquid supply path and the first space, and wherein the volume change member increases the volume of the first space for at least a part of the increase volume after the negative pressure is released.

3. The liquid supply apparatus according to claim 2, wherein the volume change member is a second flexible member which bends in the direction toward the second space from the first space and increases the volume of the first space.

4. The liquid supply apparatus according to claim 3, wherein the pressure adjustor further includes a biasing unit which biases the second flexible member in the direction opposite to the bending direction.

5. The liquid supply apparatus according to claim 3, wherein the second flexible member is formed with the same material as the first flexible member.

6. The liquid supply apparatus according to claim 1, wherein the pressure adjustor is a third flexible member which is provided so as to constitute a part of the liquid supply path, bends after the negative pressure is released, and increases a volume for at least a part of the increase volume.

7. The liquid supply apparatus according to claim 1, wherein the first directional valve includes:

a liquid container which contains liquid; and a valve body which divides the liquid container into a first space and a second space, and the pressure adjustor is a bending portion which is formed on the valve body of the first directional valve, bends after the negative pressure is released, and increases a volume for at least a part of the increase volume.

8. The liquid supply apparatus according to claim 1, wherein the liquid supply pump includes a biasing unit which biases the first flexible member in the direction opposite to the direction where the first flexible member changes when the negative pressure is applied to the negative pressure chamber, and the pressure adjustor changes a volume for at least a part of the increase volume after the negative pressure is released when a negative pressure which is higher than a biasing force by the biasing unit is applied to the negative pressure chamber.

9. A liquid ejecting apparatus comprising:

the liquid supply apparatus according to claim 1; and an ejecting unit which ejects liquid supplied from the liquid supply apparatus.

10. A liquid ejecting apparatus comprising:

the liquid supply apparatus according to claim 2; and an ejecting unit which ejects liquid supplied from the liquid supply apparatus.

11. A liquid ejecting apparatus comprising:

the liquid supply apparatus according to claim 3; and an ejecting unit which ejects liquid supplied from the liquid supply apparatus.

12. A liquid ejecting apparatus comprising:

the liquid supply apparatus according to claim 4; and an ejecting unit which ejects liquid supplied from the liquid supply apparatus.

13. A liquid ejecting apparatus comprising:

the liquid supply apparatus according to claim 5; and an ejecting unit which ejects liquid supplied from the liquid supply apparatus.

14. A liquid ejecting apparatus comprising:

the liquid supply apparatus according to claim 6; and an ejecting unit which ejects liquid supplied from the liquid supply apparatus.

15. A liquid ejecting apparatus comprising:

the liquid supply apparatus according to claim 7; and an ejecting unit which ejects liquid supplied from the liquid supply apparatus.

16. A liquid ejecting apparatus comprising:

the liquid supply apparatus according to claim 8; and an ejecting unit which ejects liquid supplied from the liquid supply apparatus.

* * * * *